US009801503B1

(12) United States Patent
Burk

(10) Patent No.: US 9,801,503 B1
(45) Date of Patent: Oct. 31, 2017

(54) PERSONAL HYGIENE CONTAINER SYSTEM AND METHOD

(71) Applicant: Dustin Burk, Pompano Beach, FL (US)

(72) Inventor: Dustin Burk, Pompano Beach, FL (US)

( * ) Notice: Subject to any disclaimer, the term of this patent is extended or adjusted under 35 U.S.C. 154(b) by 0 days.

(21) Appl. No.: 15/592,123

(22) Filed: May 10, 2017

Related U.S. Application Data

(60) Provisional application No. 62/454,066, filed on Feb. 3, 2017.

(51) Int. Cl.

| | |
|---|---|
| ***A47K 1/09*** | (2006.01) |
| ***B65D 25/24*** | (2006.01) |
| ***B65D 43/16*** | (2006.01) |
| ***B65D 25/54*** | (2006.01) |
| ***B65D 43/22*** | (2006.01) |

(52) U.S. Cl.
CPC ..... *A47K 1/09* (2013.01); *B65D 25/24* (2013.01); *B65D 25/54* (2013.01); *B65D 43/16* (2013.01); *B65D 43/22* (2013.01)

(58) Field of Classification Search
CPC ..... A47K 1/09; B65D 25/24; B65D 25/54; B65D 43/16; B65D 43/22; B65D 81/261; A47B 81/02; A47F 7/00; F16N 31/002; F16N 31/006; F16N 31/004
USPC ..... 206/37; 220/571, 571.1
See application file for complete search history.

(56) References Cited

U.S. PATENT DOCUMENTS

| | | | | |
|---|---|---|---|---|
| 4,854,457 | A | 8/1989 | Perler | |
| 5,346,094 | A * | 9/1994 | Strawser | B65D 7/42 220/571 |
| 5,522,497 | A * | 6/1996 | Stacy | A47K 1/09 206/209.1 |
| 6,371,420 | B1 | 4/2002 | Strunk | |
| 7,249,686 | B1 * | 7/2007 | Aesquivel | B65D 81/262 206/501 |
| 8,522,973 | B2 * | 9/2013 | Joseph | A47K 1/09 206/362.2 |
| 9,351,570 | B2 * | 5/2016 | Koefelda | A47B 55/00 |
| 2001/0003332 | A1 | 6/2001 | Ventnor | |
| 2007/0084810 | A1 * | 4/2007 | Morris | A47K 1/09 211/65 |
| 2008/0245681 | A1 | 10/2008 | Healis | |
| 2009/0200184 | A1 * | 8/2009 | Cullen | A47K 1/09 206/362.2 |
| 2010/0288659 | A1 | 11/2010 | Dang | |
| 2011/0174823 | A1 | 7/2011 | Silva | |

* cited by examiner

*Primary Examiner* — Andrew Perreault
(74) *Attorney, Agent, or Firm* — Integrity Patent Group, PLC; Edwin Wold

(57) ABSTRACT

A personal hygiene container system; the system provides a raised cylindrical housing having a separator and draining fence for storing personal hygiene utensils. The housing includes a removable lid and a fluid drain hole to allow excess moisture or fluids to safely flow away from the internal chamber of the housing. A draining tray is also provided to receive any excess liquid that may escape through the drain hole. The personal hygiene container system is useful for retaining personal utensils in a clean storage environment that helps prevent the buildup of mold and other bacteria, as well as preventing unsanitary airborne particles from accumulating on said hygiene utensils.

17 Claims, 5 Drawing Sheets

PERSONAL HYGIENE CONTAINER SYSTEM AND METHOD

CROSS-REFERENCE TO RELATED APPLICATION

The present application is related to and claims priority to U.S. Provisional Patent Application No. 62/454,066 filed Feb. 3, 2017, which is incorporated by reference herein in its entirety.

BACKGROUND OF THE INVENTION

The following includes information that may be useful in understanding the present disclosure. It is not an admission that any of the information provided herein is prior art nor material to the presently described or claimed inventions, nor that any publication or document that is specifically or implicitly referenced is prior art.

1. Field of the Invention

The present invention relates generally to the field of receptacles and more specifically relates to personal hygiene containers.

2. Description of Related Art

Most people store their hygiene utensils in a bathroom. These utensils are placed in small holders, typically exposed to the open air. Unsanitary particles may be airborne and attach to products such as a toothbrush, razor, dental floss, and much more. People will then unknowingly consume these particles, which can cause serious illness. Further, if these items are stored in closed containers, water buildup can occur which leads to the potential for creation of mold and other bacteria. A suitable solution is desired.

U.S. Publication No. 2011/0174823 to Ivanilda Silva relates to a toothbrush holder with disposable liner system. The described toothbrush holder with disposable liner system includes a three-tiered support structure that is substantially easier to clean than conventional designs. The disks for both versions may be identical including a top portion with a plurality of apertures for inserting the handles of a plurality of toothbrushes. The toothbrushes may rest on the center disk and it may contain numerous small apertures resembling small funnel-like holes enabling the water to be drained onto the lower disk(s). A disposable liner pad with a small tab may be placed in the bottom disk. Users may lift up on the tab to remove and discard the used pad as often as they deem necessary. A new, replacement pad may then be placed in the disk. Also a horizontally or vertically mounted plastic container is included for storing the disposable pads, which may comprise a kit.

BRIEF SUMMARY OF THE INVENTION

In view of the foregoing disadvantages inherent in the known receptacle art, the present disclosure provides a novel container for storing personal hygiene items. The general purpose of the present disclosure, which will be described subsequently in greater detail, is to provide an effective personal hygiene container system and method.

A personal hygiene container system is disclosed herein. The personal hygiene container system may include a cylindrical housing (other shapes may be available) adapted to receive personal hygiene utensils. The cylindrical housing may further include a personal hygiene utensil separator, a draining fence, a funnel-shaped bottom having a fluid drain hole, and at least two stilts. In addition, the system may feature a removable lid that completely encloses the top of the housing when in place and a draining tray configured to receive any liquid runoff from the utensils held within the housing. The draining fence helps to keep utensils effectively suspended above the fluid drain hole and may be removable from the cylindrical housing for easy cleaning. The draining tray may likewise be separable from the cylindrical housing to allow for cleaning and efficient transport of the entire system, as well as retaining water until the user dumps water into nearby sink.

According to another embodiment, a method of use for the personal hygiene container system is also disclosed herein. The method of use for the personal hygiene container system may include opening the removable lid to the cylindrical housing, preparing personal hygiene utensils for storage by rinsing or cleaning, and placing the personal hygiene utensils inside of the cylindrical housing.

For purposes of summarizing the invention, certain aspects, advantages, and novel features of the invention have been described herein. It is to be understood that not necessarily all such advantages may be achieved in accordance with any one particular embodiment of the invention. Thus, the invention may be embodied or carried out in a manner that achieves or optimizes one advantage or group of advantages as taught herein without necessarily achieving other advantages as may be taught or suggested herein. The features of the invention which are believed to be novel are particularly pointed out and distinctly claimed in the concluding portion of the specification. These and other features, aspects, and advantages of the present invention will become better understood with reference to the following drawings and detailed description.

BRIEF DESCRIPTION OF THE DRAWINGS

The figures which accompany the written portion of this specification illustrate embodiments and methods of use for the present disclosure, a personal hygiene container system and method, constructed and operative according to the teachings of the present disclosure.

The various embodiments of the present invention will hereinafter be described in conjunction with the appended drawings, wherein like designations denote like elements.

DETAILED DESCRIPTION

As discussed above, embodiments of the present disclosure relate to a personal hygiene container and more particularly to a personal hygiene container system and method as used to improve the sanitary cleaning and storage of personal hygiene items in an efficient and effective manner.

Generally, the present invention provides users with a storage container for hygiene utensils such as toothbrushes, razors, tongue scrapers, and more. It substantially prevents unwanted contact with unsanitary particles in the air, especially when hygiene utensils are stored in a bathroom. This eliminates water build-up at the bottom of the container such that water is drained via gravity and is moved to the outer perimeter of the tray below. As such it effectively reduces the amount of bacteria, germs, etc. present in a bathroom from accumulating on hygiene utensils. The present invention allows users to store their sanitary items in a bathroom without worry of cross-contamination with unsanitary particles.

The device may include a cylindrical enclosure with a removable lid, draining fence, funnel-shaped bottom region, and at least two holes for the facilitation of drainage via gravity. The container is intended to keep hygiene utensils enclosed, away from particles in the air while retaining little to no water within the container. Water drops out of the container onto a tray on which the container rests. Due to the tray's design, the water is moved to its outer perimeter. The water buildup on the tray can be easily dumped into a sink since the tray is separate from the container.

The container is designed to be practical and aesthetically-pleasing. The container can be clear, but may be slightly tinted or constructed from opaque materials to provide color to the aesthetic appearance of the device. On top of the container can be a spring hinge which is actuated via a button, in order to open the container. A small hole near the top makes it possible for the container to drain when completely closed at the top. Water drainage is intended to prevent mold and other bacteria from forming. Individuals can store toothbrushes, razors, and other utensils within the container. Upon reading this specification, it should be appreciated that, under appropriate circumstances, considering such issues as user preferences, design preference, structural requirements, marketing preferences, cost, available materials, technological advances, etc., other personal hygiene container arrangements such as, for example, a personal hygiene container constructed from non-transparent plastics or other materials, etc., may be sufficient.

Figure 1:
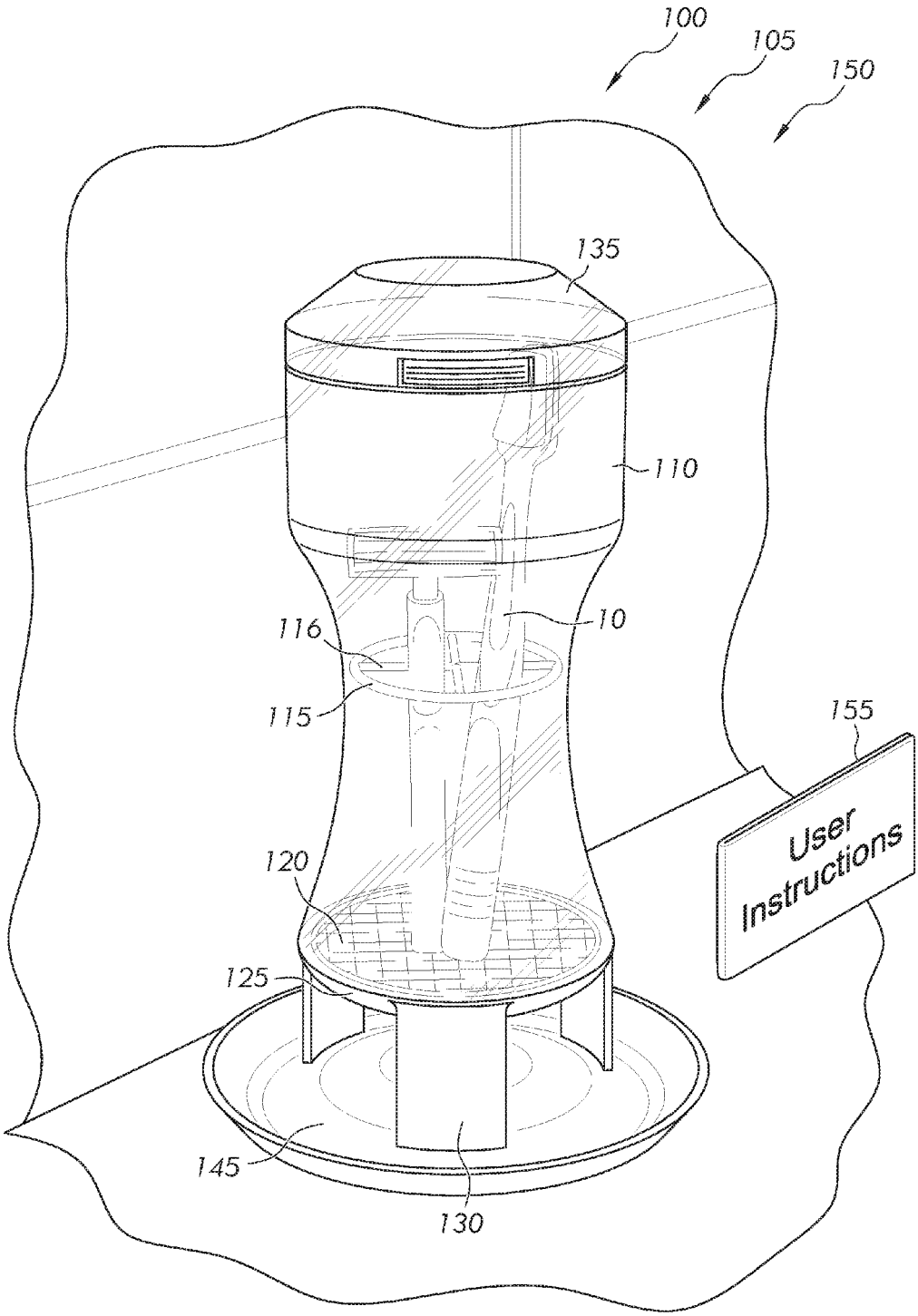
FIG. 1 is a perspective view of the personal hygiene container system during an 'in-use' condition, according to an embodiment of the disclosure.

Referring now more specifically to the drawings by numerals of reference, there is shown in FIGS. 1-4, various views of a personal hygiene container system 100. FIG. 1 shows a personal hygiene container system 100 during an 'in-use' condition 150, according to an embodiment of the present disclosure. Here, the personal hygiene container system 100 may be beneficial for use by a user to store personal hygiene items. As illustrated, the personal hygiene container system 100 may include a cylindrical housing 110 including a personal hygiene utensil separator 115 having a plurality of apertures 116 permitting insertion of personal hygiene utensils 10 therethrough, a draining fence 120, and a funnel-shaped bottom 125. The cylindrical housing 110 may further include stilts 130, a removable lid 135, and a draining tray 145.

According to one embodiment, the personal hygiene container system 100 may be arranged as a kit 105. In particular, the personal hygiene container system 100 may further include a set of instructions 155. The instructions 155 may detail functional relationships in relation to the structure of the personal hygiene container system 100 (such that the personal hygiene container system 100 can be used, maintained, or the like, in a preferred manner).

Figure 2:
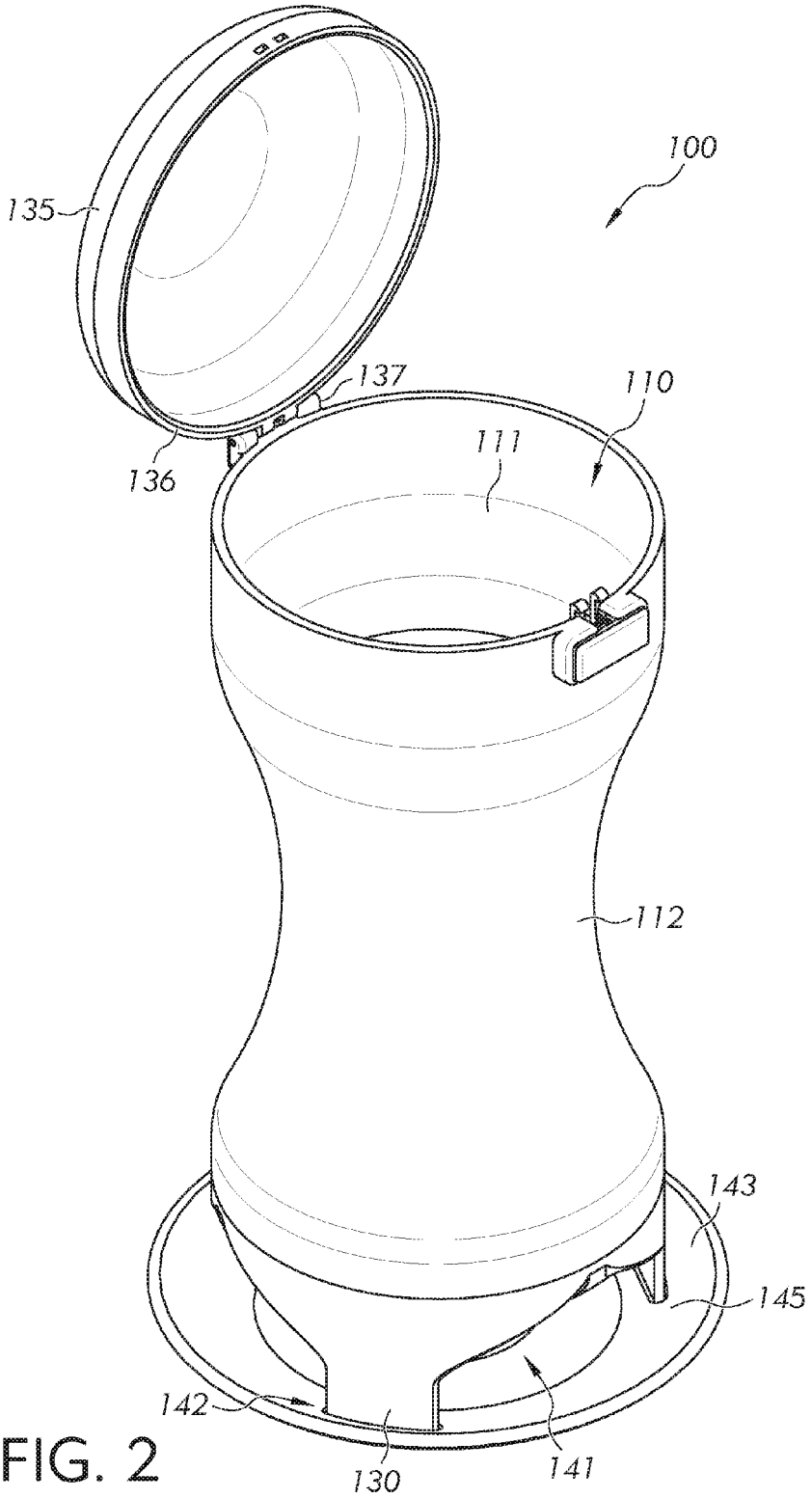
FIG. 2 is a top perspective view of the personal hygiene container system of FIG. 1, according to an embodiment of the present disclosure.

FIG. 2 shows the personal hygiene container system 100 of FIG. 1, according to an embodiment of the present disclosure. As above, the personal hygiene container system 100 may include a cylindrical housing 110 defining an internal volume 111, where the cylindrical housing 110 may include a concave siding 112. The cylindrical housing 110 may also include stilts 130 and a draining tray 145 that features a raised hill 141, a raised-perimeter-wall 143 for holding in excess drainage, and divots 142 configured to receive the stilts 130 of the cylindrical housing 110. In addition, the cylindrical housing 110 may include a removable lid 135 and a hinge 137, where the removable lid 135 may feature an offset edge 136 around its perimeter configured to frictionally couple within the cylindrical housing 110.

Figure 3:
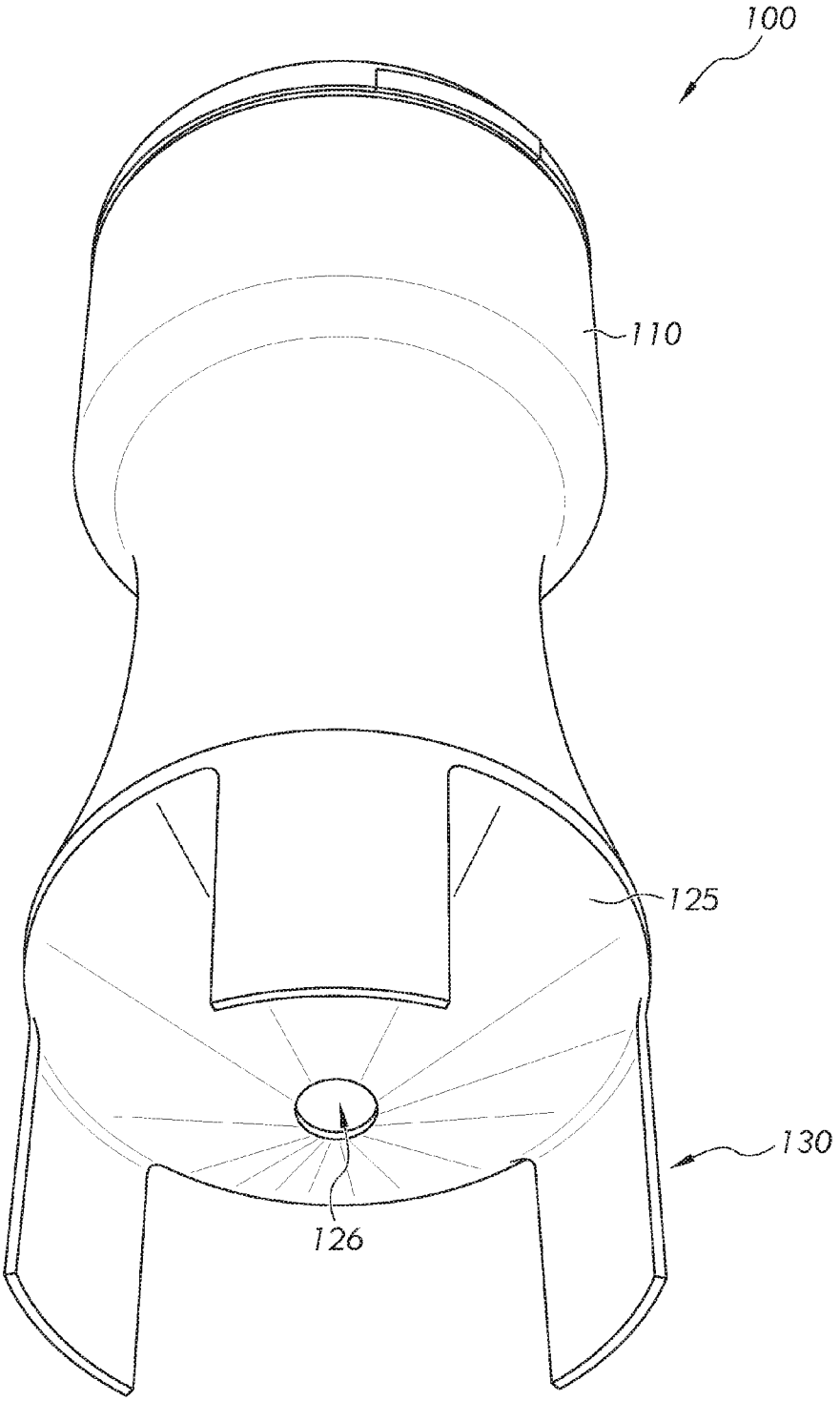
FIG. 3 is a bottom perspective view of the personal hygiene container system of FIG. 1, according to an embodiment of the present disclosure.

FIG. 3 is a bottom perspective view of the personal hygiene container system 100 of FIG. 1, according to an embodiment of the present disclosure. This figure illustrates the cylindrical housing 110 from a lower angle to detail its funnel-shaped bottom 125 that includes a fluid drain hole 126. FIG. 3 also shows a different angle of the included stilts 130, which may be used to provide clearance and stability for the cylindrical housing 110.

Figure 4:
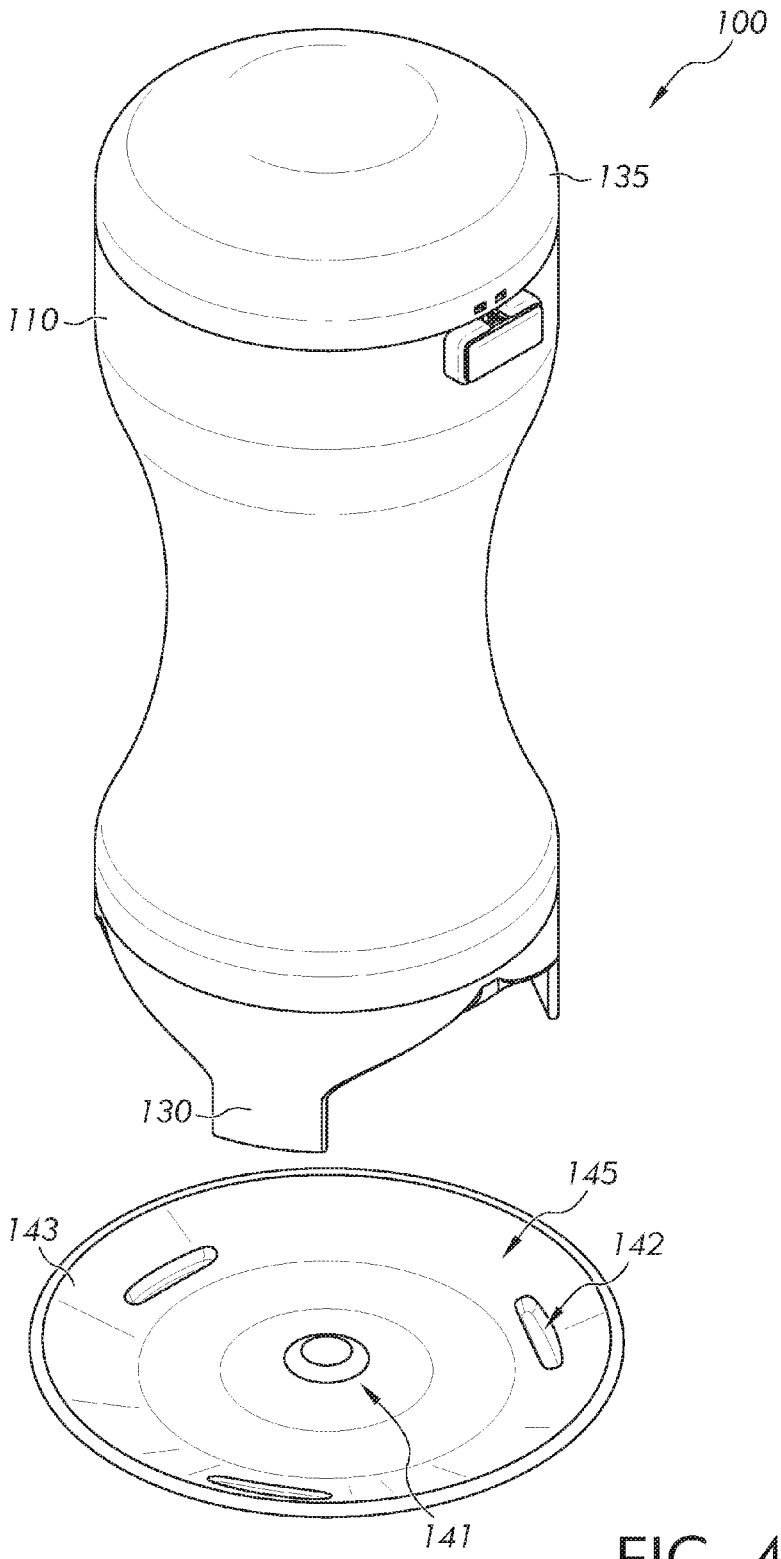
FIG. 4 is a perspective view of the personal hygiene container system of FIG. 1, according to an embodiment of the present disclosure.

FIG. 4 is a perspective view of the personal hygiene container system 100 of FIG. 1, according to an embodiment of the present disclosure. In this embodiment, a cylindrical housing 110 is shown with a removable lid 135 in the closed position. The cylindrical housing 110 with stilts 130, is shown being suspended above the included draining tray 145. This illustration gives an alternate view of the draining tray 145 with its raised hill 141, raised-perimeter-wall 143, and divots 142 to more clearly show how the cylindrical housing 110 may fit together.

Figure 5:
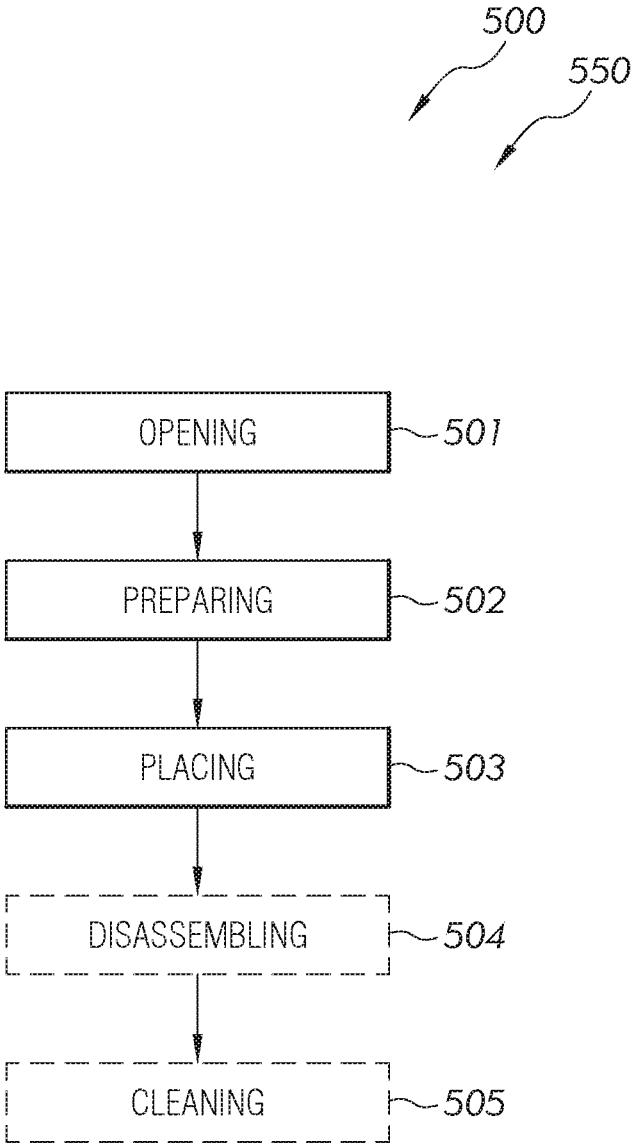
FIG. 5 is a flow diagram illustrating a method of use for the personal hygiene container system, according to an embodiment of the present disclosure.

FIG. 5 is a flow diagram 550 illustrating a method of use 500 for the personal hygiene container system 100, according to an embodiment of the present disclosure. In particular, the method of use 500 for the personal hygiene container system 100 may include one or more components or features of the personal hygiene container system 100 as described above. As illustrated, the method of use 500 may include the steps of: step one 501, opening the removable lid 135 to the cylindrical housing 110; step two 502, preparing the personal hygiene utensils 10 for storage by rinsing or cleaning; and step three 503, placing the personal hygiene utensil 10 inside of the cylindrical housing 110. Step three 504 may comprise disassembling; and step five 505 cleaning as needed. Personal hygiene utensils 10 can be removed and used and replaced inside as desired.

It should be noted that step four 504 and step five 505 are optional steps and may not be implemented in all cases. Optional steps of method of use 500 are illustrated using dotted lines in FIG. 5 so as to distinguish them from the other steps of method of use 500. It should also be noted that the steps described in the method of use can be carried out in many different orders according to user preference. The use of "step of" should not be interpreted as "step for", in the claims herein and is not intended to invoke the provisions of 35 U.S.C. §112(f). It should also be noted that, under appropriate circumstances, considering such issues as design preference, user preferences, marketing preferences, cost, structural requirements, available materials, technological advances, etc., other methods for use of the personal hygiene container system 100 (e.g., different step orders within above-mentioned list, elimination or addition of certain steps, including or excluding certain maintenance steps, etc.), are taught herein.

The embodiments of the invention described herein are exemplary and numerous modifications, variations and rearrangements can be readily envisioned to achieve substantially equivalent results, all of which are intended to be embraced within the spirit and scope of the invention. Further, the purpose of the foregoing abstract is to enable the U.S. Patent and Trademark Office and the public generally, and especially the scientist, engineers and practitioners in the art who are not familiar with patent or legal terms or phraseology, to determine quickly from a cursory inspection the nature and essence of the technical disclosure of the application.

What is claimed is new and desired to be protected by Letters Patent is set forth in the appended claims:

1. A personal hygiene container system, the system comprising:

a) a cylindrical housing comprising:
  i) an internal volume;
  ii) a personal hygiene utensil separator;
  iii) a draining fence;
  iv) at least two stilts; and
  v) a funnel-shaped bottom comprising:
    (1) a fluid drain hole;
b) a removable lid; and
c) a removable draining tray comprising:
  i) at least two divots;
d) wherein said internal volume is physically bounded by said cylindrical housing, said funnel-shaped bottom, and said removable lid;
e) wherein said cylindrical housing, said funnel-shaped bottom, and said removable lid are structured and arranged to physically configure said internal volume to receive personal hygiene utensils;
f) wherein said at least two divots are structured and arranged in said funnel-shaped bottom to mate with said at least two stilts wherein said funnel-shaped bottom is removably mechanically attached to said cylindrical housing;
g) wherein said removable lid is structured and arranged with said cylindrical housing to completely encloses a top of said cylindrical housing when said removable lid is positioned on the top of said cylindrical housing;
h) wherein said personal hygiene utensil separator and said draining fence are structured and arranged with said cylindrical housing for removably coupling of said personal hygiene utensil separator and said draining fence to said cylindrical housing;
i) wherein said draining fence is structured and arranged with said cylindrical housing to keep the personal hygiene utensils suspended above said funnel-shaped bottom;
j) wherein said at least two stilts are structured and arranged with said cylindrical housing and with said at least two divots within said removable draining tray to provide a clearance between said fluid drain hole and said removable draining tray; and
k) wherein said cylindrical housing is structured and arranged with said removable tray such that said cylindrical housing rests completely within a perimeter of said removable draining tray.

2. The personal hygiene container system of claim 1, wherein said cylindrical housing measures at least 8 inches in length.

3. The personal hygiene container system of claim 1, wherein said personal hygiene utensil separator comprises a plurality of apertures permitting insertion of said personal hygiene utensils therethrough.

4. The personal hygiene container system of claim 1, wherein said draining fence features a semi-rigid grid configured to let water pass through towards said funnel-shaped bottom.

5. The personal hygiene container system of claim 1, wherein said stilts measure at least 1 inch in length.

6. The personal hygiene container system of claim 1, wherein said removable draining tray features a raised hill in a center of its top surface configured to feed excess liquid away from said fluid drain hole towards its perimeter.

7. The personal hygiene container system of claim 6, wherein said removable draining tray features a raised-perimeter-wall configured to hold in excess drainage.

8. The personal hygiene container system of claim 7, wherein said removable draining tray measures at least 5 inches in diameter.

9. The personal hygiene container system of claim 1, wherein said removable lid is structured and arranged with an offset edge around its perimeter and further structured and arranged with said cylindrical housing to frictionally couple within said cylindrical housing.

10. The personal hygiene container system of claim 1, wherein said personal hygiene utensil separator, said draining fence, said removable lid, and said removable draining tray are all separable from said cylindrical housing.

11. The personal hygiene container system of claim 1, wherein said system are constructed only from dishwasher-safe materials.

12. The personal hygiene container system of claim 1, wherein said cylindrical housing is substantially transparent.

13. The personal hygiene container system of claim 9, wherein said removable lid includes a hinge structured and arranged with cylindrical housing for coupling said removable lid to said cylindrical housing.

14. The personal hygiene container system of claim 1, wherein said internal volume of said cylindrical housing is sufficient to hold at least 4 of said personal hygiene utensils.

15. The personal hygiene container system of claim 1, wherein said cylindrical housing features a concave siding.

16. A personal hygiene container system, the system comprising:

a) a cylindrical housing comprising:
  i) an internal volume;
  ii) a personal hygiene utensil separator;
  iii) a draining fence;
  iv) at least two stilts; and
  v) a funnel-shaped bottom comprising:
    (1) a fluid drain hole;
b) a removable lid; and
c) a removable draining tray comprising:
  i) at least two divots;
d) wherein said internal volume is physically bounded by said cylindrical housing, said funnel-shaped bottom, and said removable lid;
e) wherein said cylindrical housing, said funnel-shaped bottom, and said removable lid are structured and arranged to physically configure said internal volume to receive personal hygiene utensils;
f) wherein said at least two divots are structured and arranged in said funnel-shaped bottom to mate with said at least two stilts wherein said funnel-shaped bottom is removably mechanically attached to said cylindrical housing;
g) wherein said removable lid is structured and arranged with said cylindrical housing to completely encloses a top of said cylindrical housing when said removable lid is positioned on the top of said cylindrical housing;

h) wherein said personal hygiene utensil separator and said draining fence are structured and arranged with said cylindrical housing for removably coupling of said personal hygiene utensil separator and said draining fence to said cylindrical housing;

i) wherein said draining fence is structured and arranged with said cylindrical housing to keep the personal hygiene utensils suspended above said funnel-shaped bottom;

j) wherein said at least two stilts are structured and arranged with said cylindrical housing and with said at least two divots within said removable draining tray to provide a clearance between said fluid drain hole and said removable draining tray; and k) wherein said cylindrical housing is structured and arranged with said removable tray such that said cylindrical housing rests completely within a perimeter of said removable draining tray;

l) wherein said cylindrical housing measures at least 8 inches in length;

m) wherein said personal hygiene utensil separator comprises a plurality of apertures permitting insertion of said personal hygiene utensils therethrough;

n) wherein said draining fence features a semi-rigid grid configured to let water pass through towards said funnel-shaped bottom;

o) wherein said stilts measure at least 1 inch in length;

p) wherein said removable draining tray features a raised hill in a center of its top surface configured to feed excess liquid away from said fluid drain hole towards its perimeter;

q) wherein said removable draining tray features divots configured to receive said stilts of said cylindrical housing;

r) wherein said removable draining tray features a raised-perimeter-wall configured to hold in excess drainage;

s) wherein said removable draining tray measures at least 5 inches in diameter;

t) wherein said removable lid is structured and arranged with an offset edge around its perimeter and further structured and arranged with said cylindrical housing to frictionally couple within said cylindrical housing;

u) wherein said personal hygiene utensil separator, said draining fence, said removable lid, and said removable draining tray are all separable from said cylindrical housing;

v) wherein all components of said system are constructed from dishwasher-safe materials;

w) wherein said cylindrical housing is substantially transparent;

x) wherein said removable lid includes a hinge structured and arranged with cylindrical housing for coupling said removable lid to said cylindrical housing;

y) wherein said internal volume of said cylindrical housing is sufficient to hold at least 4 of said personal hygiene utensils; and z) wherein said cylindrical housing features a concave siding.

17. The personal hygiene container system of claim 16, further comprising set of instructions; and a) wherein the system is arranged as a kit.

* * * * *